US009249551B1

(12) United States Patent
White

(10) Patent No.: US 9,249,551 B1
(45) Date of Patent: Feb. 2, 2016

(54) CONCRETE SHEET PILE CLAMP ASSEMBLIES AND METHODS AND PILE DRIVING SYSTEMS FOR CONCRETE SHEET PILES

(71) Applicant: American Piledriving Equipment Inc., Kent, WA (US)

(72) Inventor: David White, Kent, WA (US)

(73) Assignee: American Piledriving Equipment, Inc., Kent, WA (US)

( * ) Notice: Subject to any disclaimer, the term of this patent is extended or adjusted under 35 U.S.C. 154(b) by 41 days.

(21) Appl. No.: 13/794,615

(22) Filed: Mar. 11, 2013

Related U.S. Application Data

(60) Provisional application No. 61/732,217, filed on Nov. 30, 2012.

(51) Int. Cl.
*E02D 7/18* (2006.01)
*E02D 13/00* (2006.01)
*E02D 11/00* (2006.01)

(52) U.S. Cl.
CPC *E02D 7/18* (2013.01); *E02D 11/00* (2013.01); *E02D 13/00* (2013.01)

(58) Field of Classification Search
CPC ..... E02D 7/18; E02D 11/00; E02D 13/00; E02D 7/14; E02D 7/00
USPC ..... 405/228, 231, 232, 253, 256, 274, 275, 405/276; 173/49, 132; 279/156
See application file for complete search history.

(56) References Cited

U.S. PATENT DOCUMENTS

| | | | |
|---|---|---|---|
| 5,015 | A | 3/1847 | Ingalls |
| 369,176 | A | 8/1887 | Gerstein |
| 628,962 | A | 7/1899 | Speer |
| 1,128,808 | A | 2/1915 | Manoogian |

(Continued)

FOREIGN PATENT DOCUMENTS

| | | |
|---|---|---|
| CA | 2452448 | 6/2005 |
| CA | 2506382 | 7/2011 |

(Continued)

OTHER PUBLICATIONS

A series of photographs identified by Reference Nos. APE01147-APE01159, 1990-1993, 13 pages.

(Continued)

*Primary Examiner* — John Kreck
*Assistant Examiner* — Carib Oquendo
(74) *Attorney, Agent, or Firm* — Michael R. Schacht; Schacht Law Office, Inc.

(57) ABSTRACT

A clamp assembly for a pile driving system for driving a concrete sheet pile, the clamp assembly comprising a clamp body, a first clamp member supported relative to the clamp body, and a second clamp member supported for movement relative to the clamp body, and a bumper member. A clamp region is formed between the first and second clamp members. The bumper member is supported relative to the clamp body above the clamp region. The clamp body is configured such that the concrete sheet pile enters the clamp region from below. The second clamp member is displaced towards the first clamp member to engage the concrete sheet pile in the clamp region. The bumper member resiliently deforms to inhibit direct transmission of forces between the concrete sheet pile and the clamp body during driving of the concrete sheet pile.

14 Claims, 3 Drawing Sheets

(56) References Cited

U.S. PATENT DOCUMENTS 1,213,800 A 1/1917 Piper
1,288,989 A 12/1918 Rees
1,322,470 A 11/1919 Schenk
1,343,902 A 6/1920 Chapman
1,400,801 A 12/1921 Cohen
1,654,093 A 12/1927 Reid
1,702,349 A 2/1929 Krell
1,748,555 A 2/1930 Kinney
1,762,037 A 6/1930 Taylor
1,903,555 A 4/1933 Robertson
1,914,899 A 6/1933 Syme
1,988,173 A 1/1935 Kersting
2,068,045 A 1/1937 Wohlmeyer
2,126,933 A 8/1938 Stone et al.
2,350,921 A 6/1944 Pinazza
2,577,252 A 12/1951 Kjellman
2,809,014 A 10/1957 Lawrence
2,842,972 A 7/1958 Houdart
2,859,628 A 11/1958 Arko
2,952,132 A 9/1960 Urban
3,094,007 A 6/1963 Luhrs
3,096,075 A 7/1963 Brown
3,100,382 A 8/1963 Muller
3,101,552 A 8/1963 Tandler et al.
3,115,198 A 12/1963 Kuss
3,149,851 A 9/1964 Adams
3,172,485 A 3/1965 Spannhake et al.
3,177,029 A 4/1965 Larson
3,227,483 A 1/1966 Guild et al.
3,243,190 A 3/1966 Peregrine
3,289,774 A 12/1966 Bodine, Jr.
3,300,987 A 1/1967 Maeda
3,300,988 A 1/1967 Phares
3,313,376 A 4/1967 Holland, Sr.
3,316,983 A 5/1967 Goodman
3,371,727 A 3/1968 Belousov et al.
3,391,435 A 7/1968 Lebelle
3,394,766 A 7/1968 Lebelle
3,447,423 A 6/1969 Henry
3,450,398 A 6/1969 Barnes et al.
3,530,947 A 9/1970 Gendron
3,577,645 A 5/1971 Zurawski
3,620,137 A 11/1971 Prasse
3,672,032 A 6/1972 Witherspoon
3,684,037 A 8/1972 Bodine
3,686,877 A 8/1972 Bodin
3,711,161 A 1/1973 Proctor et al.
3,720,435 A 3/1973 Leyn
3,734,209 A 5/1973 Haisch et al.
3,786,874 A 1/1974 Demichelis et al.
3,797,570 A 3/1974 Leutwyler
3,828,864 A 8/1974 Haverkamp et al.
3,854,418 A 12/1974 Bertin
3,861,664 A 1/1975 Durkee
3,871,617 A 3/1975 Majima
3,874,244 A 4/1975 Rasmussen et al.
3,891,186 A 6/1975 Thorsell
3,907,042 A 9/1975 Halwas et al.
3,952,796 A 4/1976 Larson
3,959,557 A 5/1976 Berry
3,998,063 A 12/1976 Harders
4,018,290 A 4/1977 Schmidt
4,067,369 A 1/1978 Harmon
4,082,361 A 4/1978 Lanfermann
4,099,387 A 7/1978 Frederick et al.
4,100,974 A 7/1978 Pepe
4,113,034 A 9/1978 Carlson
4,119,159 A 10/1978 Arentsen
4,143,985 A 3/1979 Axelsson et al.
4,144,939 A 3/1979 Knothe
4,155,600 A 5/1979 Lanfermann et al.
4,166,508 A 9/1979 van den Berg
4,180,047 A 12/1979 Bertelson
4,195,698 A 4/1980 Nakagawasai
4,248,550 A 2/1981 Blaschke et al.
4,285,405 A 8/1981 Weir, Jr.
4,308,924 A * 1/1982 Boguth ..... 173/135
4,312,413 A 1/1982 Loftis
4,375,927 A 3/1983 Kniep
4,380,918 A 4/1983 Killop
4,428,699 A 1/1984 Juhola
4,436,452 A 3/1984 Bodine
4,455,105 A 6/1984 Juhola
4,505,614 A 3/1985 Anschutz
4,537,527 A 8/1985 Juhola et al.
4,547,110 A 10/1985 Davidson
4,553,443 A 11/1985 Rossfelder et al.
4,567,952 A 2/1986 Lemaire et al.
4,601,615 A 7/1986 Cavalli
4,603,748 A 8/1986 Rossfelder et al.
4,627,768 A 12/1986 Thomas et al.
4,637,475 A 1/1987 England et al.
4,650,008 A 3/1987 Simson
4,687,026 A 8/1987 Westman
4,735,270 A 4/1988 Fenyvesi
4,755,080 A 7/1988 Cortlever et al.
4,757,809 A 7/1988 Koeneman et al.
4,758,148 A 7/1988 Jidell
4,813,814 A 3/1989 Shibuta et al.
4,819,740 A 4/1989 Warrington
4,863,312 A 9/1989 Cavalli
4,961,471 A 10/1990 Ovens
5,018,251 A 5/1991 Brown
5,076,090 A 12/1991 Cetnarowski
5,088,565 A 2/1992 Evarts
5,092,399 A 3/1992 Lang
5,117,925 A 6/1992 White
5,213,449 A 5/1993 Morris
5,263,544 A 11/1993 White
5,281,775 A 1/1994 Gremillion
5,343,002 A 8/1994 Gremillion
5,355,964 A 10/1994 White
5,375,897 A 12/1994 Gazel-Anthoine
5,385,218 A 1/1995 Migliori
5,388,652 A 2/1995 Smith
5,409,070 A 4/1995 Roussy
5,423,633 A 6/1995 Verstraeten
5,439,326 A 8/1995 Goughnour et al.
5,529,132 A 6/1996 Evarts
5,544,979 A 8/1996 White
5,549,168 A 8/1996 Sadler et al.
5,609,380 A 3/1997 White
5,653,556 A 8/1997 White
5,658,091 A 8/1997 Goughnour et al.
5,794,716 A 8/1998 White
5,811,741 A 9/1998 Coast et al.
5,836,205 A 11/1998 Meyer
5,918,511 A 7/1999 Sabbaghian et al.
6,039,508 A 3/2000 White
6,129,159 A 10/2000 Scott et al.
6,216,394 B1 4/2001 Fenelon
6,234,260 B1 5/2001 Coast et al.
6,360,829 B1 3/2002 Naber et al.
6,386,295 B1 5/2002 Suver
6,427,402 B1 8/2002 White
6,431,795 B2 8/2002 White
6,447,036 B1 9/2002 White
6,484,553 B1 11/2002 Devers
6,543,966 B2 4/2003 White
6,557,647 B2 5/2003 White
6,582,158 B1 6/2003 Van Stein
6,648,556 B1 11/2003 White
6,652,194 B2 11/2003 Ingle
6,672,805 B1 1/2004 White
6,691,797 B1 2/2004 Hart
6,732,483 B1 5/2004 White
6,736,218 B1 5/2004 White
6,752,043 B2 6/2004 Carlson
6,860,338 B2 3/2005 Salesse et al.
6,896,448 B1 5/2005 White
6,908,262 B1 6/2005 White
6,942,430 B1 9/2005 Suver
6,988,564 B2 1/2006 White
7,043,806 B2 5/2006 Schrock et al.

(56) References Cited

U.S. PATENT DOCUMENTS

| | | | |
|---|---|---|---|
| 7,168,890 | B1 | 1/2007 | Evarts |
| 7,338,232 | B2 | 3/2008 | Nasr |
| 7,392,855 | B1 | 7/2008 | White |
| 7,407,343 | B2 | 8/2008 | van Halteren et al. |
| 7,694,747 | B1 | 4/2010 | White |
| 7,708,499 | B1 | 5/2010 | Evarts et al. |
| 7,824,132 | B1 | 11/2010 | White |
| 7,854,571 | B1 | 12/2010 | Evarts |
| 7,950,876 | B2 | 5/2011 | Suver |
| 7,950,877 | B2 | 5/2011 | Evarts |
| 8,070,391 | B2 | 12/2011 | White |
| 8,181,713 | B2 | 5/2012 | White |
| 8,186,452 | B1 | 5/2012 | White et al. |
| 8,434,969 | B2 | 5/2013 | White |
| 8,496,072 | B2 | 7/2013 | White |
| 8,511,941 | B2 | 8/2013 | Curic et al. |
| 2003/0089525 | A1 | 5/2003 | Sherwood |
| 2005/0000736 | A1 | 1/2005 | Maki |
| 2005/0013675 | A1 | 1/2005 | Bengston et al. |
| 2005/0061550 | A1 | 3/2005 | Harthauser |
| 2005/0201836 | A1 | 9/2005 | Suver |
| 2006/0052818 | A1 | 3/2006 | Drake et al. |
| 2006/0113456 | A1 | 6/2006 | Miller |
| 2007/0110521 | A1 | 5/2007 | Nimens |
| 2008/0031695 | A1 | 2/2008 | Nasr |
| 2008/0310923 | A1 | 12/2008 | Jinnings et al. |
| 2009/0290940 | A1 | 11/2009 | Martin |
| 2010/0303552 | A1 | 12/2010 | Yingling et al. |
| 2011/0091285 | A1 | 4/2011 | Thurner et al. |
| 2011/0162859 | A1 | 7/2011 | White |
| 2012/0255783 | A1 | 10/2012 | Curtis et al. |
| 2012/0292062 | A1 | 11/2012 | White |
| 2013/0149040 | A1 | 6/2013 | Evarts |
| 2014/0294513 | A1 | 10/2014 | Krinner et al. |

FOREIGN PATENT DOCUMENTS

| | | | |
|---|---|---|---|
| DE | 4010357 | | 10/1990 |
| DE | 102006053482 | | 6/2008 |
| EP | 0172960 | | 5/1986 |
| EP | 0103283 | | 7/1988 |
| EP | 362158 | | 4/1990 |
| EP | 526743 | | 10/1993 |
| FR | 838717 | | 3/1939 |
| FR | 2560247 | | 8/1985 |
| GB | 2003769 | | 3/1979 |
| GB | 2023496 | | 1/1980 |
| GB | 2028902 | | 3/1980 |
| GB | 2043755 | | 10/1980 |
| GB | 2160566 | | 12/1985 |
| GB | 2363133 | | 12/2001 |
| JP | 61221416 | | 10/1986 |
| JP | 5246681 | | 9/1993 |
| JP | 6136751 | | 5/1994 |
| JP | 2006028772 | A | 2/2006 |
| NL | 42349 | | 1/1938 |
| NL | 65252 | | 2/1950 |
| NL | 7710385 | | 3/1978 |
| NL | 7707303 | | 1/1979 |
| NL | 7805153 | | 11/1979 |
| RU | 26058 | U1 | 11/2002 |
| SU | 1027357 | | 7/1983 |
| WO | 8707673 | | 12/1987 |
| WO | 8805843 | | 8/1988 |

OTHER PUBLICATIONS

International Construction Equipment, Inc., "Hydraulic Vibratory Driver/Extractors for Piling and Caisson Work," undated, 10 pages.

International Construction Equipment, Inc., "Hydraulic Vibratory Driver/Extractors for Piling and Caisson Work," Ref. No. V7-0890-51, undated, 3 pages.

Japan Development Consultants, Inc., "Castle Board Drain Method" Japanese language brochure, Ref. Nos. APE00857-APE00863, Aug. 1976, 7 pages.

Korean language documents identified by Ref. Nos. APE00864-APE00891, dates from 1982-1997, 28 pages.

www.mmsonline.com/columns/micro-keying-keeps-a-better-grip.aspx, Seibert, Stan, Modern Machine Shop: "Micro-Keying Keeps a Better Grip," Aug. 1, 1992, 2 pages.

Report identifying systems for driving mandrels carrying wick drain material into the earth, Ref. Nos. APE0510-APE0536, 1994, 27 pages.

Schematic drawings, Ref. Nos. APE01038, APE01039, APE0339, undated, 3 pages.

"The 1st Report on the Treatment of Soft Foundation in Juck Hyun Industrial Site", Ref. Nos. APE00854-APE00856, 1976, 3 pages.

* cited by examiner

CONCRETE SHEET PILE CLAMP ASSEMBLIES AND METHODS AND PILE DRIVING SYSTEMS FOR CONCRETE SHEET PILES

RELATED APPLICATIONS

This application, U.S. application Ser. No. 13/794,615 filed Mar. 11, 2013, claims benefit of U.S. Provisional Patent Application Ser. No. 61/732,217 filed Nov. 30, 2012, the contents of which are incorporated herein by reference.

TECHNICAL FIELD

The present invention relates to pile driving systems and methods and, more particularly, to clamp systems and methods adapted to apply vibratory driving forces to concrete sheet piles.

BACKGROUND

Piles are often used in construction to support structures, roadways, earthworks, and the like. At least a portion of a pile is typically arranged within the ground. While a pile may be placed into an excavated hole, piles are typically driven into the ground by the application of a driving force to the top of the pile. The driving force may be one or more of static forces (e.g., weight of pile and pile driving equipment), impulse forces (e.g., drop hammer, diesel hammer), crowding forces (e.g., hydraulic ram), and vibratory forces (e.g., eccentric vibro). The exact nature of the driving force is typically selected for a particular type of pile and, to some extent, to a particular set of soil conditions.

A pile is typically driven by applying the driving force along a longitudinal axis of the pile being driven. As discussed above, a driving force applied to a pile to be driven often includes a vibratory force component. The vibratory force component results in forces being applied to the pile being driven in both directions along the longitudinal axis of the pile. Depending on the nature of the pile and soil composition, vibratory forces can significantly enhance the speed at which piles are driven. Vibratory forces can also be gentler on a pile structure being driven than, say, impulse forces.

Vibratory forces are highly appropriate for use with certain concrete piles and certain soil conditions. The present invention is of particular relevance in the context of applying a driving force having a vibratory force component to a concrete sheet pile. In general, a sheet pile may be characterized as having a width dimension that is significantly greater than a thickness dimension. Therefore, in comparison to a pile driver for cylindrical piles, at least a portion of a pile driving system for sheet piles is typically adapted to accommodate the wide and thin form factor of sheet piles. The form factor of a concrete sheet pile is also basically wide and thin, but a concrete sheet pile is typically a precast, reinforced, concrete structure.

In the context of concrete sheet piles being driven with a driving force having a vibratory force component, the pile driving system typically comprises a vibratory device and a clamp system. The vibratory device generates the vibratory force component, and the clamp system ensures that the vibratory forces are applied in both directions along the longitudinal axis of the pile being driven. The clamp system is adapted for the particular form factor of the pile being driven.

The need exists for improved pile driving systems and methods for concrete sheet piles and, more specifically, to clamp systems and methods for effectively applying the vibratory force component of a driving force to a concrete sheet pile with minimal damage to the concrete sheet pile.

SUMMARY

The present invention may be embodied as clamp assembly for a pile driving system for driving a concrete sheet pile. The clamp assembly comprises a clamp body, a first clamp member supported relative to the clamp body, and a second clamp member supported for movement relative to the clamp body, and a bumper member. A clamp region is formed between the first and second clamp members. The bumper member is supported relative to the clamp body above the clamp region. The clamp body is configured such that the concrete sheet pile enters the clamp region from below. The second clamp member is displaced towards the first clamp member to engage the concrete sheet pile in the clamp region. The bumper member resiliently deforms to inhibit direct transmission of forces between the concrete sheet pile and the clamp body during driving of the concrete sheet pile.

The present invention may also be embodied as method of clamping a concrete sheet pile to a pile driving system, the method comprising the following steps. A first clamp member is supported relative to a clamp body. A second clamp member is movably supported for movement relative to the clamp body such that a clamp region is formed between the first and second clamp members. A bumper member is supported relative to the clamp body above the clamp region. The concrete sheet pile is caused to enter the clamp region from below. The second clamp member is displaced towards the first clamp member to engage the concrete sheet pile in the clamp region. Direct transmission of forces between the concrete sheet pile and the clamp body is inhibited during driving of the concrete sheet pile by causing the bumper member to resiliently deform.

The present invention may be embodied as a pile driving system for driving a concrete sheet pile. The example pile driving assembly comprises a vibratory device and a clamp assembly. The clamp assembly comprises a clamp body operatively to the vibratory device, a first clamp member supported relative to the clamp body, a second clamp member supported for movement relative to the clamp body, and a bumper member supported relative to the clamp body above the clamp region. A clamp region is formed between the first and second clamp members. The clamp body is configured such that the concrete sheet pile enters the clamp region from below. The second clamp member is displaced towards the first clamp member to engage the concrete sheet pile in the clamp region. The vibratory device is operated to apply vibratory forces to the concrete sheet pile through the clamp body and the first and second clamp members. The bumper member resiliently deforms to inhibit direct transmission of forces between the concrete sheet pile and the clamp body during driving of the concrete sheet pile.

DETAILED DESCRIPTION

Figure 1:
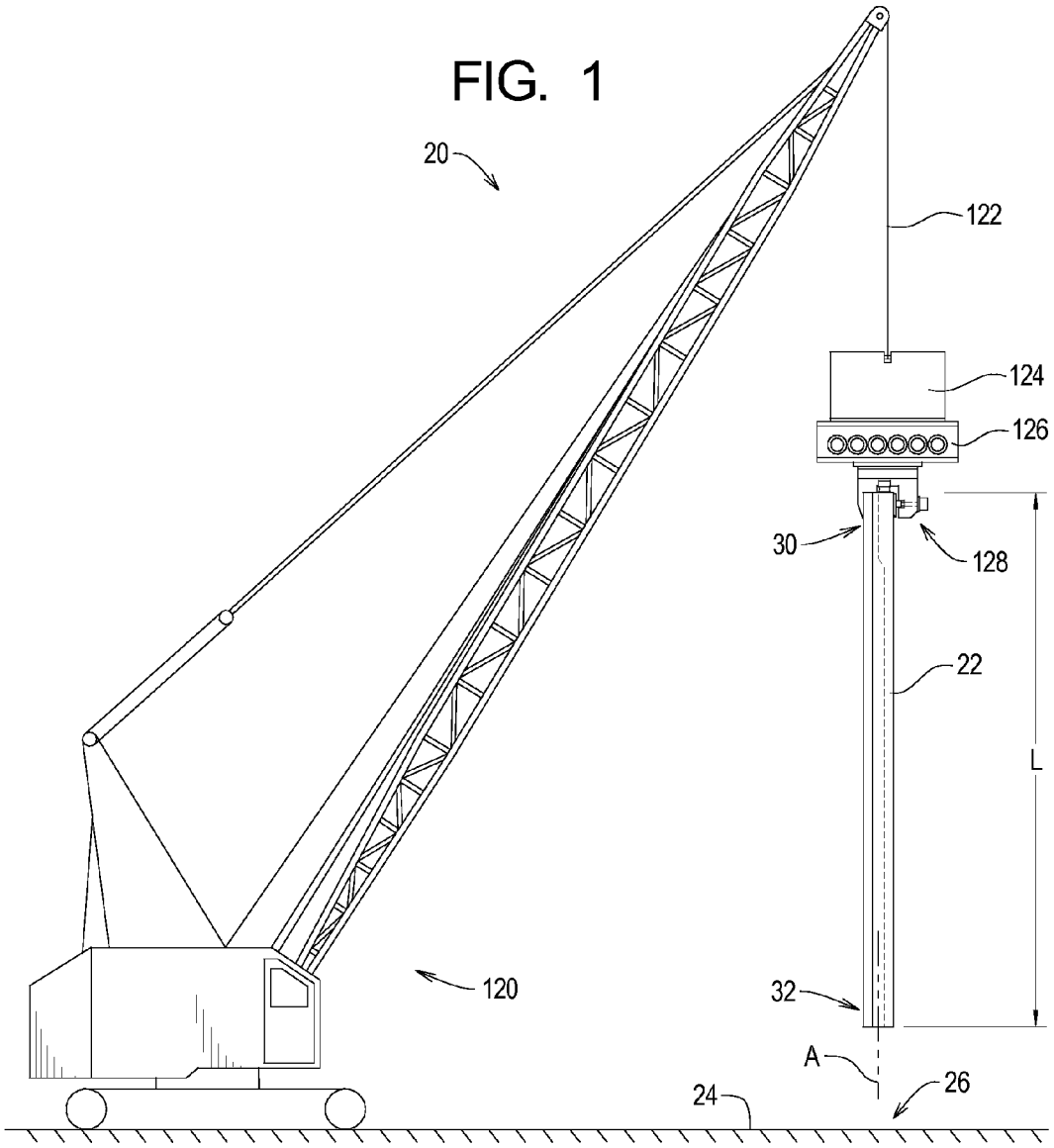
FIG. 1 is a side elevation view of an example pile driving system and clamp system of the present invention for driving a concrete sheet pile.

Referring initially to FIG. 1 of the drawing, depicted therein is a pile driving system 20 constructed in accordance with, and embodying, the principles of the present invention. The example pile driving system 20 is illustrated in connection with a pile 22 to be driven into the ground 24 at a desired location 26. The example pile 22 is a concrete sheet pile.

FIGS. 2-5 illustrate certain details of the example pile 22 driven by the example pile driving system 20. The pile 22 is not per se part of the present invention and may take on configurations other than those depicted in FIGS. 1-5, but an understanding of the example pile 22 will facilitate an understanding of the example pile driving system 20.

Figure 5:
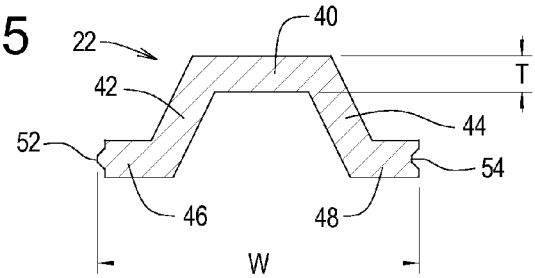
FIG. 5 is a top plan section view taken along lines 5-5 in FIG. 3.

FIG. 1 illustrates that the example pile 22 is an elongate structure defining a longitudinal axis A extending along a lengthwise dimension L thereof. A first end portion 30 and a second end portion 32 are spaced at opposite ends of the pile 22 along the longitudinal axis A. The first end portion 30 is adapted to be engaged by the pile driving system 20 as will be described in further detail below. FIG. 5 illustrates that a width dimension W of the pile 22 is significantly larger than a thickness dimension T thereof.

FIGS. 2-5 further illustrate that the example pile 22 defines a center portion 40, first and second arm portions 42 and 44, and first and second edge portions 46 and 48. A gripping projection 50 extends from the center portion 40 at the first end portion 30 of the example pile 22. The gripping projection 50 further extends between the first and second arm portions 42 and 44 at the first end portion 30. A first edge projection 52 is formed on the first edge portion 46, and a second edge recess 54 is formed in the second edge portion 48. First and second engaging surfaces 60 and 62 are formed by the gripping projection 50 and the center portion 40 at the first end portion 30, respectively. An upper surface 64 is defined by the top of the pile 22. A transition surface 66 extends between the first engaging surface 60 and the center portion 40 outside of the first end portion 30 of the pile 22.

The engaging surfaces 60 and 62 are substantially parallel to each other, and the upper surface 64 is substantially orthogonal to the engaging surfaces 60 and 62. Typically, the engaging surfaces 60 and 62 are substantially vertical and the upper surface 64 is substantially horizontal when the pile 22 is driven into the ground 24.

With the foregoing discussion of the example concrete sheet pile 22 in mind, the details of construction and operation of the example pile driving system 20 will now be described in further detail with respect to FIGS. 1, 6, and 7.

As shown in FIG. 1, the example pile driving system 20 comprises a crane 120 from which a crane line 122 extends. A vibration suppressor 124 is connected to the crane line 122. A vibratory device 126 is connected to the vibration suppressor 124. A clamp 128 is connected to the vibratory device 126.

To prepare the example pile driving system 20 for use, the clamp 128 is rigidly connected to the vibratory device 126, and the vibratory device 126 is rigidly connected to the vibration suppressor 124. The vibration suppressor 124 is suspended from the crane 120 by the crane line 122. The example crane 120 takes the form of a tracked vehicle capable of moving across the ground 24. The clamp 128 is adapted to be substantially rigidly connected to the pile 22 as will be described in further detail below.

During use, the clamp 128 is rigidly connected to the pile 22, and the crane 120 is operated to suspend the pile 22 above the desired location 26 on the ground 24. The crane 120 is then operated such that the second end portion 32 of the pile is in contact with the ground 24 at the desired location 26. The vibratory device 126 is then operated such that the vibratory forces created by the vibratory device 126 are transmitted to the clamp 128 and to the pile 22. The vibratory forces created by the vibratory device 126 and the static forces created by the weight of the pile 22, clamp 128, vibratory device 126, and vibration suppressor 124 create a driving force that drives the pile 22 into the ground 24 at the desired location 26. The vibration suppressor 124 inhibits transmission of the vibratory forces from the vibratory device 126 to the crane line 122 and thus to the crane 120.

Figure 6:
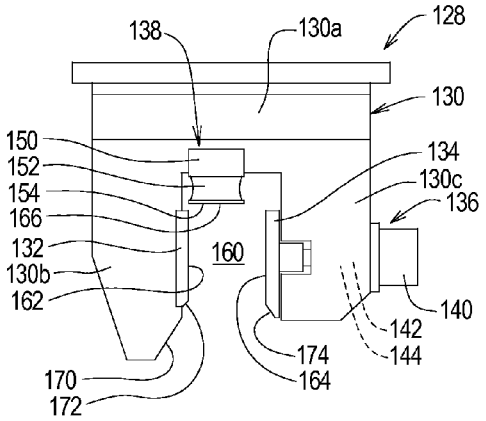
FIG. 6 is a side elevation view of the example clamp system of FIG. 1 in an open configuration.
Figure 7:
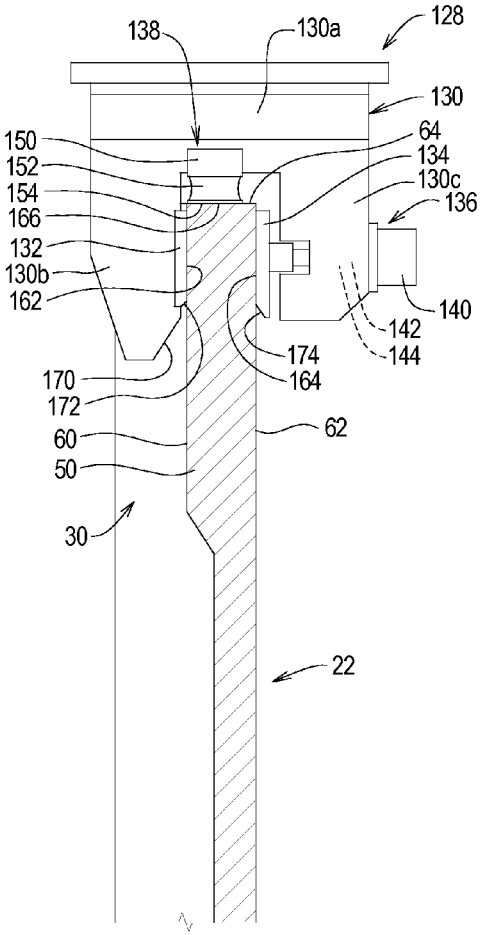
FIG. 7 is a side elevation view similar to FIG. 6 illustrating the example clamp system in a clamped configuration relative to the example concrete pile as depicted in FIG. 1.

Referring now to FIGS. 6 and 7, it can be seen that the example clamp 128 comprises a clamp body 130, a first clamp member 132, a second clamp member 134, an actuator assembly 136, and a bumper assembly 138. The example actuator assembly 136 comprises an actuator 140 and an actuator shaft 142. The example actuator shaft 142 extends through an actuator opening 144 formed in the clamp body 130. The example actuator 140 is a hydraulically operated device that uses hydraulic pressure to displace the actuator shaft 142 relative to the actuator 140. The example bumper assembly 138 comprises a bumper base 150, a bumper member 152, and a bumper plate 154. The example clamp body 130 comprises a clamp body base portion 130*a*, a first clamp body arm 130*b*, and a second clamp body arm 130*c*. In the example clamp 128, the first clamp member 132 is rigidly connected to the first clamp body arm 130*b*, the second clamp member 134 is movably supported relative to the second clamp body arm 130*c*, and the bumper assembly 138 is rigidly connected to the clamp body base portion 130*a*.

The first clamp member 132 is rigidly connected to the clamp body 130 on one side of a clamp region 160. The actuator shaft 142 extends through the actuator opening 144 to an opposite side of the clamp region 160. The second clamp member 134 is rigidly connected to the actuator shaft 142 such that the second clamp member 134 is also on the opposite side of the clamp region 160 from the first clamp member 132. The first clamp member 132 defines first clamp surface 162, and the second clamp member 134 defines a second clamp surface 164. The example clamp surfaces 162 and 164 are substantially parallel to each other, and the clamp region 160 lies between these surfaces 162 and 164. In the example clamp 128, first, second, and third guide surfaces 170, 172, and 174 are formed to guide the pile 22 into the clamp region 160 as will be described in further detail below.

The example bumper member 152 is secured to the example bumper base 150 by any appropriate means such as adhesive, clamp, bolts, and the like. The example bumper member 152 is similarly secured to the example bumper plate 154 by any appropriate means such as adhesive, clamp, bolts, and the like. The example bumper base 150 is in turn secured to the clamp body 130 such that the bumper member 152 is arranged above the clamp region 160. The example bumper plate 154 defines a bumper surface 166 that is arranged to define an upper end of the clamp region 160. The example bumper surface 166 is substantially orthogonal to the first and second clamp surfaces 162 and 164. During driving of the pile 22, the first and second clamp surfaces 162 and 164 are substantially vertical, and the bumper surface 166 is substantially horizontal.

The bumper member 152 is made of a resiliently deformable material that is capable of absorbing at least a portion of shocks from external bodies coming into contact with the bumper member 152. The example bumper member 152 may be made of any resiliently deformable material capable of meeting the functional requirements as described below without substantial degradation in physical structure of the bumper member 152. As one example, the bumper member 152 may be made of a rubber-like elastomeric material. In particular, the bumper member 152 may be made of an elastomeric material similar to or the same as the material used in conventional vibration suppression systems for vibrational pile drivers.

In preparing to operate the pile driving system 20, the actuator 140 is initially operated to retract the actuator shaft 142 as depicted in FIG. 6 such that the clamp 128 is in an open configuration. In this open configuration, the first and second clamp surfaces 162 and 164 are spaced from each other such that the dimensions of the clamp region 160 are greatest. The crane 120 is displaced such that the first end portion 30 of the pile 22 enters the clamp region 160. Continued displacement of the clamp 128 relative to the pile 22 allows the bumper surface 166 to come into contact with the upper surface 64 of the pile 22.

The actuator 140 is then operated to displace the second clamp member 134 towards the first clamp member 132 such that the first and second clamp surfaces 162 and 164 come into contact with the first and second engaging surfaces 60 and 62. The actuator assembly 136 thus applies a clamping force on the center portion 40 and gripping projection 50 of the pile 22 that securely holds the pile 22 relative to the clamp 128. The pile 22 may then be lifted into position above the desired location 26 and lowered until the second end portion 32 contacts the ground 24 at the desired location 26.

Figure 2:
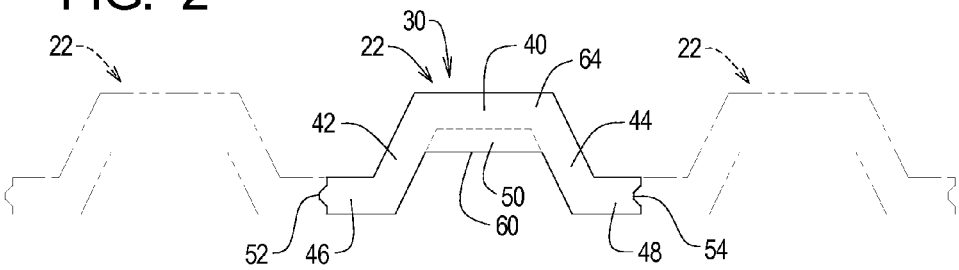
FIG. 2 is top plan view highlighting one example concrete sheet pile such as the example concrete sheet pile of FIG. 1 in an overall installation of a plurality of similar concrete sheet piles.
Figure 3:
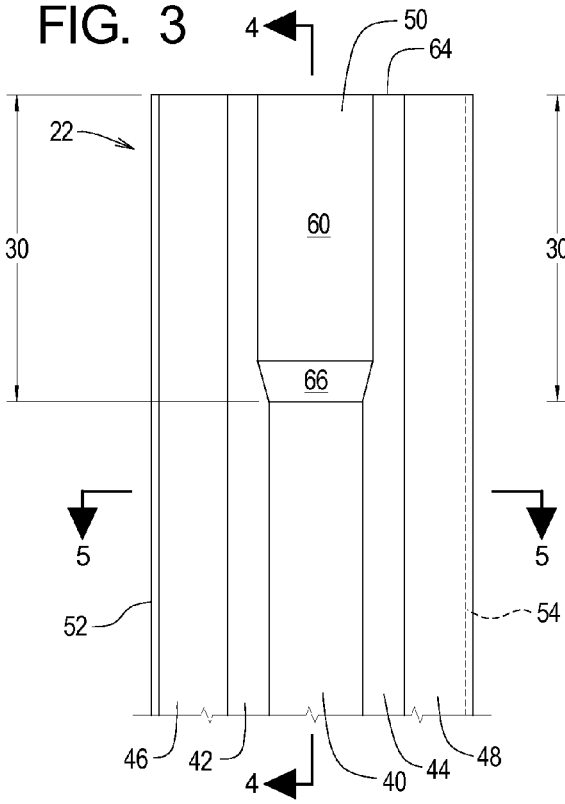
FIG. 3 is a front elevation view of an upper end of the example concrete sheet pile of FIG. 1.
Figure 4:
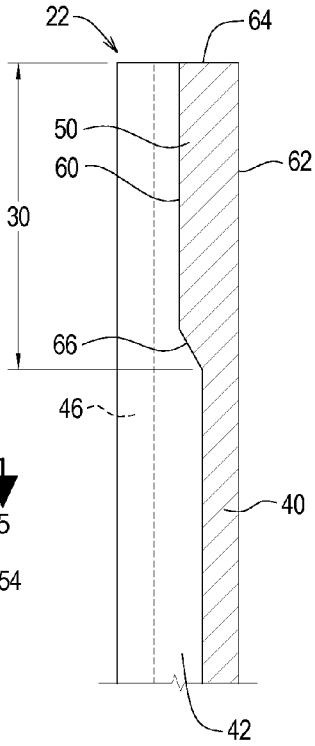
FIG. 4 is a side elevation section view taken along lines 4-4 in FIG. 3.

The crane 120 is then used to suspend the pile 22 at a desired orientation and the vibratory device 126 is operated. The vibratory forces generated by the vibratory device 126 are transmitted to the pile 22 through the clamp 128. The vibratory forces, along with static force generated by the weight of the pile 22, vibration suppressor 124, vibratory device 126, and clamp 128, create the driving force that drives the pile 22 into position at the desired location. With the example pile 22, the desired position is typically next to an adjacent pile 22 as shown in FIG. 2 such that the first edge projection 52 of one of the piles 22 is received by the second edge recess 54 of an adjacent one of the piles 22.

Further, the first and second clamp surfaces 162 and 164 are sized, dimensioned, and/or configured to minimize slippage between the clamp 128 and the pile 22. However, if such slippage does occur, which is likely under wet, muddy conditions, the bumper plate 154 comes into contact with the upper surface 64 of the pile 22. Should slippage occur and the bumper plate 154 come into contact with the upper surface 64, the bumper member 152 resiliently deforms to absorb shocks that would otherwise be transmitted to the upper surface 64, possibly damaging the pile 22.

What is claimed is:

1. A clamp assembly for a pile driving system for driving a concrete sheet pile, the clamp assembly comprising:

a clamp body;

a first clamp member supported relative to the clamp body; and a second clamp member supported for movement relative to the clamp body, where a clamp region is formed between the first and second clamp members; and a bumper member is supported relative to the clamp body above the clamp region;

a bumper plate is secured to the bumper member;

the clamp body is configured such that the concrete sheet pile enters the clamp region from below; wherein the second clamp member is displaced towards the first clamp member to engage the concrete sheet pile in the clamp region;

the bumper date is arranged to come into contact with the concrete sheet pile during transmission of forces between the concrete sheet pile and the bumper member such that, if slippage occurs between the concrete sheet pile and the clamp assembly when a driving force is being applied through the clamp assembly to the concrete sheet pile, the bumper member resiliently deforms to absorb shocks that would otherwise be transmitted to the upper surface and possibly damage the concrete sheet pile.

2. The clamp assembly as recited in claim 1, further comprising an actuator member configured to displace the second clamp member towards the first clamp member.

3. The clamp assembly as recited in claim 1, further comprising a bumper base, wherein:

the bumper member is secured to the bumper base; and the bumper base is secured to the clamp body.

4. The clamp assembly as recited in claim 1, in which the clamp body comprises:

a clamp body base;

a first clamp body arm; and a second clamp body arm; wherein the first clamp member is rigidly connected to the first clamp body arm;

the second clamp member is movably supported by the second clamp body arm; and the bumper member is supported by the clamp body base.

5. The clamp assembly as recited in claim 4, further comprising an actuator member mounted on the second clamp body arm, where the actuator member is configured to displace the second clamp member towards the first clamp member.

6. A method of clamping a concrete sheet pile to a pile driving system, the method comprising the steps of:

providing a clamp body;

supporting a first clamp member relative to the clamp body; and movably supporting a second clamp member for movement relative to the clamp body such that a clamp region is formed between the first and second clamp members;

supporting a bumper member relative to the clamp body above the clamp region;

causing the concrete sheet pile to enter the clamp region from below;

displacing the second clamp member towards the first clamp member to engage the concrete sheet pile in the clamp region; and if slippage occurs between the concrete sheet pile and the clamp assembly when a driving force is being applied through the clamp assembly to the concrete sheet pile, the bumper member resiliently deforms to absorb shocks that would otherwise be transmitted to the upper surface and possibly damage the concrete sheet pile; and securing a bumper late to the bumper member such that the bumper plate comes into contact with the concrete sheet pile during transmission of forces between the concrete sheet pile and the bumper member.

7. The method as recited in claim 6, further comprising the step of arranging an actuator member displace the second clamp member towards the first clamp member.

8. The method as recited in claim 6, further comprising the steps of:

securing the bumper member to a bumper base; and securing the bumper base to the clamp body.

9. The method as recited in claim 6, in which the step of supporting a bumper member relative to the clamp body comprises the steps of rigidly connecting the first clamp member is rigidly to a first clamp body arm of the clamp body;

movably supporting the second clamp member on a second clamp body arm of the clamp body;

securing the bumper member to a bumper base; and the bumper member is supported by securing the bumper base to the clamp body.

10. The method as recited in claim 9, further comprising the steps of:

mounting an actuator member on the second clamp body arm; and configuring the actuator member to displace the second clamp member towards the first clamp member.

11. A pile driving system for driving a concrete sheet pile, the pile driving assembly comprising:

a vibratory device;

a clamp assembly comprising a clamp body operatively to the vibratory device;

a first clamp member supported relative to the clamp body;

a second clamp member supported for movement relative to the clamp body, where a clamp region is formed between the first and second clamp members;

a bumper member supported relative to the clamp body above the clamp region; and a bumper plate is secured to the bumper member; wherein the clamp body is configured such that the concrete sheet pile enters the clamp region from below;

the second clamp member is displaced towards the first clamp member to engage the concrete sheet pile in the clamp region;

the vibratory device is operated to apply vibratory forces to the concrete sheet pile through the clamp body and the first and second clamp members; and the bumper plate is arranged to come into contact with the concrete sheet pile during transmission of forces between the concrete sheet pile and the bumper member such that, if slippage occurs between the concrete sheet pile and the clamp assembly when a driving force is being applied through the clamp assembly to the concrete sheet pile, the bumper member resiliently deforms to absorb shocks that would otherwise be transmitted to the upper surface and possibly damage the concrete sheet pile.

12. The pile driving system as recited in claim 11, further comprising:

a vibratory suppression assembly operatively connected to the vibratory device; and a crane operatively connected to the vibratory suppression assembly; where the crane supports the vibratory suppression assembly, the vibratory device, the clamp assembly, and concrete sheet pile during driving of the concrete sheet pile.

13. The pile driving system as recited in claim 11, in which the clamp assembly further comprises a bumper base, wherein:

the bumper member is secured to the bumper base; and the bumper base is secured to the clamp body.

14. The pile driving system as recited in claim 11, in which the clamp body comprises:

a clamp body base;

a first clamp body arm; and a second clamp body arm; wherein the vibratory device is rigidly connected to the clamp body base;

the first clamp member is rigidly connected to the first clamp body arm;

the second clamp member is movably supported by the second clamp body arm; and the bumper member is supported by the clamp body base.

* * * * *